US010681465B1

(12) United States Patent
Castillo

(10) Patent No.: US 10,681,465 B1
(45) Date of Patent: Jun. 9, 2020

(54) COIL SPRING SUSPENSION SYSTEM FOR LOUDSPEAKER

(71) Applicant: TYMPHANY ACOUSTIC TECHNOLOGY (HUIZHOU) CO., LTD., Guang Dong (CN)

(72) Inventor: Jorge Alejandro López Castillo, Taipei (TW)

(73) Assignee: TYMPHANY ACOUSTIC TECHNOLOGY (HUIZHOU) CO., LTD., Huizhou, Guangdong Province (CN)

( * ) Notice: Subject to any disclaimer, the term of this patent is extended or adjusted under 35 U.S.C. 154(b) by 0 days.

(21) Appl. No.: 16/507,354

(22) Filed: Jul. 10, 2019

(51) Int. Cl.

| | |
|---|---|
| ***H04R 7/20*** | (2006.01) |
| ***H04R 9/04*** | (2006.01) |
| ***H04R 9/06*** | (2006.01) |
| ***H04R 1/00*** | (2006.01) |

(52) U.S. Cl.
CPC ..... *H04R 7/20* (2013.01); *H04R 1/00* (2013.01); *H04R 9/043* (2013.01); *H04R 9/045* (2013.01); *H04R 9/06* (2013.01)

(58) Field of Classification Search
CPC . H04R 7/20; H04R 9/043; H04R 9/06; H04R 9/045; H04R 1/00
See application file for complete search history.

(56) References Cited

U.S. PATENT DOCUMENTS

2008/0285788 A1* 11/2008 Lemarquand ..... H04R 9/06 381/415
2016/0381460 A1* 12/2016 Chiang ..... H04R 7/125 381/426

* cited by examiner

*Primary Examiner* — Tuan D Nguyen
(74) *Attorney, Agent, or Firm* — Finnegan, Henderson, Farabow, Garrett & Dunner, LLP

(57) ABSTRACT

A suspension arrangement for an audio loudspeaker including a spring element disposed within a voice coil former, where the spring element includes a top portion connected to the voice coil former and an opposite bottom portion connected to a motor of the loudspeaker, and where the spring element is disposed coaxially with the voice coil former and with the motor.

17 Claims, 2 Drawing Sheets

COIL SPRING SUSPENSION SYSTEM FOR LOUDSPEAKER

TECHNICAL FIELD

The present disclosure relates to audio loudspeakers and more particularly to a suspension system disposed with audio loudspeakers.

BACKGROUND

A traditional loudspeaker, as shown in FIG. 1, consists of an outer basket structure having a basket 4 connected to a U-yoke 10. A coil former 8, coil 9, magnet 11, and top plate 12 are disposed within the U-yoke 10. A dust cup 1 and cone 2 extend across an opening delimited by the basket 4. The uppermost end of the cone 2 is connected to the upper part of the basket 4 by a surround 3. A spider 6 connects the coil former 8 with the middle part of the basket 4. An upper cavity 5 and a lower cavity 7 are delimited as illustrated by the various structural elements of the loudspeaker.

The surround 3 and the spider 6 form the conventional suspension elements of the traditional loudspeaker and are intended to provide a restoring force to the moving parts 1, 2, 8, 9 while centering and stabilizing the coil 9 within the magnetic gap. However, for some designs, the spider could become problematic due to its location, design and materials employed.

The spider element 6 is designed to center the coil 9 into the magnetic gap and to provide restoring force to the moving parts of the loudspeaker. As mentioned, the spider 6 is connected to the voice coil former at its inner diameter and to the basket at its outer diameter. The rolling cross-sectional shape of the spider and the material of which it is made, both provide elastic properties to this element. During sound reproduction, the spider needs enough room in the system to move up and down, following the coil armature, so that it does not interfere with any other element. Such interference may produce an undesired buzzing noise. Thus, the position of the spider 6 within the loudspeaker is an important consideration. The spider 6 is disposed close to the basket 4, the cone 2, the motor 14, the coil 9, and the lead wire (not shown). In addition, the spider contributes to the delineation of the air cavities 5, 7 within the loudspeaker, which may lead to noise artifacts when significant airflows take place (e.g., during the reproduction of low frequencies). Conventional spiders are usually made of cloth impregnated with a resin. Stiffness can vary significantly depending upon the supplier and the particular design of the spider. As such, consistency of the spiders in terms of stiffness is difficult to control.

A loudspeaker structure is needed in which the suspension elements address the challenges. The disclosed embodiments include a loudspeaker structure, and particularly a spider suspension element, that may take up less space within the loudspeaker, may be positioned so as not to interfere with other elements of the loudspeaker, and may be provided with a more consistent and predictable stiffness.

BRIEF SUMMARY

The disclosed embodiments may include a suspension arrangement for an audio loudspeaker wherein a spring element may be disposed within a voice coil former, where the spring element includes a top portion connected to the voice coil former and an opposite bottom portion connected to a motor of the loudspeaker, and where the spring element is disposed coaxially with the voice coil former and with the motor.

The disclosed embodiments may also include a suspension arrangement for an audio loudspeaker, the loudspeaker not including a spider suspension element, the suspension arrangement including a single coil spring disposed centrally within a voice coil former and a surround connected at one end to a basket of the loudspeaker and at an opposite end to a diaphragm. The coil spring includes a top portion connected to the voice coil former and an opposite bottom portion connected to a motor of the loudspeaker. The single coil spring includes a longitudinal spring axis, the surround includes a longitudinal surround axis, the voice coil former is configured to move in a direction of travel and includes a longitudinal former axis, and the motor includes a longitudinal motor axis. The spring axis is collinear with the surround axis, the former axis, and the motor axis. The spring axis is parallel to the direction of travel. The coil spring comprises an electrically conductive element having two isolated conductive paths, where a first conductive path has a first polarity and a second conductive path has a second polarity, where the first polarity is opposite to the second polarity, and where the first and second conductive paths extend to a terminal disposed within in the loudspeaker.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
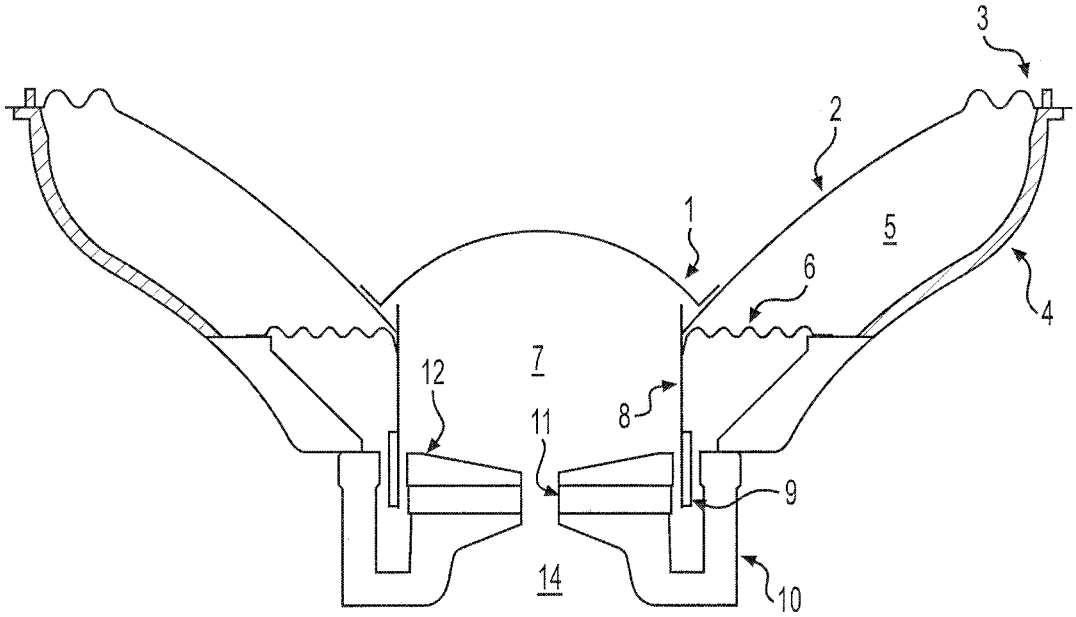
FIG. 1 (PRIOR ART)
FIG. 1 is a cross-sectional view of a loudspeaker according to the prior art.
Figure 2:
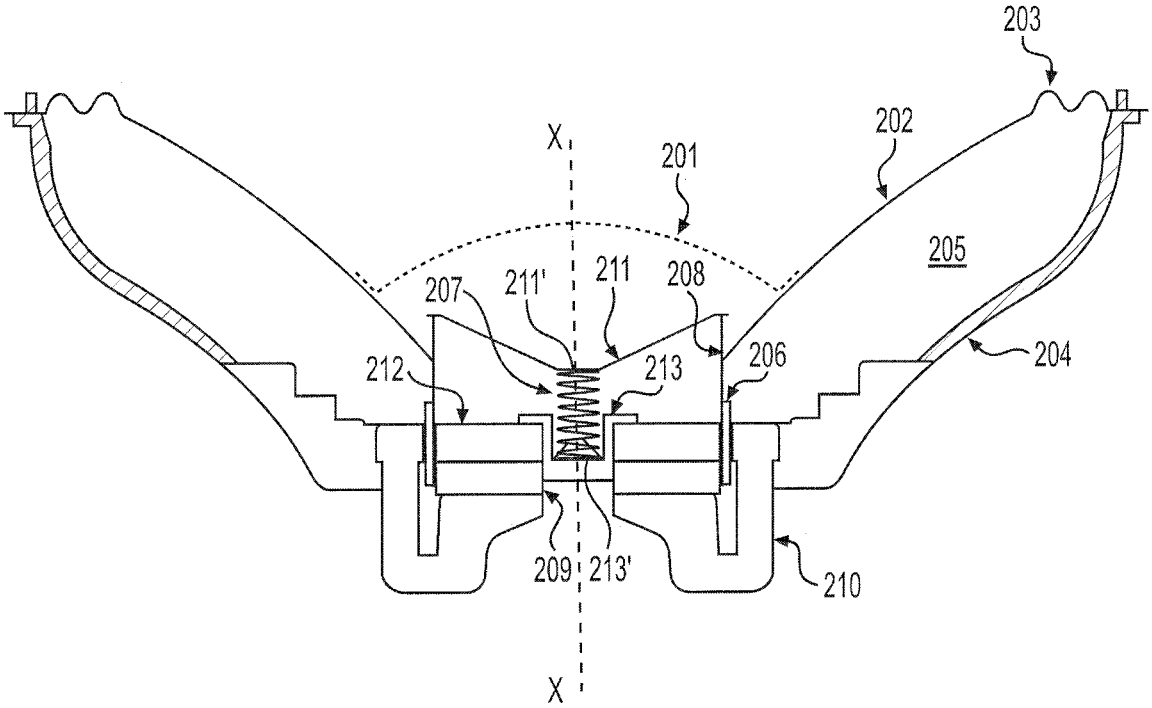
FIG. 2 is a cross-sectional view of a loudspeaker according to one embodiment of the invention.

A loudspeaker in one non-limiting exemplary embodiment is shown in FIG. 2 as including a dust cup 201 extending over a diaphragm cone 202 which is connected to a basket 204 by way of a surround 203. The cone 202 descends from the surround 203 to a voice coil former 208. A coil 206 is arranged outside of the voice coil former 208 and a magnet 209 is contained within the voice coil former 208. A top plate 212 is disposed above the magnet 209 and a U-yoke is disposed beneath the voice coil former arrangement and is connected to the basket 204.

The loudspeaker of FIG. 2 notably does not include a spider suspension element as seen in conventional loudspeakers. Instead, the configuration of FIG. 2 includes a coil spring 207 disposed within the voice coil former 208. The spring 207 is, for example, made of a metallic material, such as aluminum, steel or copper, and provides a restoring force to the moving elements of the system (e.g., elements 201, 202, 203, 206, 208) during sound reproduction. Additionally, the spring 207 also presents resistance against off-axis torsions, which means that the spring 207 tends to keep the voice coil 206 centered in the magnetic gap. The spring element 207 may facilitate manufacturing, may be adjusted to a desired stiffness, and is easy to replicate.

The coil spring 207 may be implemented into the exemplary loudspeaker arrangement as follows: a lower end of the spring 207 is attached to a fixture 213 which is disposed on a top of the top-plate 212 and is recessed into a motor of the loudspeaker. As shown in FIG. 2, this fixture 213 may include a U-shaped cross-sectional profile. An upper part of the spring 207 is connected to a coupling element 211 which joins together the spring 207 and the voice coil former 208. Elements 213 and 211, adapt to the upper and lower ends of the spring 207, holding the spring 207 in place and aligning the spring 207 for axial compression and expansion movements. Two small steps 211' and 213' can be seen in FIG. 2 for this purpose, although they are just examples of possible implementations.

The element 211 provides a strong connection between the voice coil former 208 and the spring 207. At the same time, the element 211 does not interfere with any other element in the loudspeaker system during sound reproduction.

In an alternate embodiment, the connector element 211 may serve as a dust cap and the element 201 in FIG. 2 may be omitted. In this configuration, the connector element 211 would connect at either end to the cone 202 and also be connected to the voice coil former 208 and the spring 207 in the manner discussed above.

The loudspeaker of FIG. 2 includes a single spring 207 arranged centrally and coaxially within the loudspeaker structure. That is, the single spring 207 is arranged coaxially with the voice coil former 208, the coil 206, and the magnet 209. The spring may additionally be arranged coaxially with the dust cap 201, cone 202, surround 203, basket 204, and U-yoke 210. In the illustrated embodiment, the spring 207 may reside entirely within the voice coil former 208. In FIG. 2, an axis X-X illustrates a central axis of the loudspeaker. All of the various elements of the loudspeaker (e.g., the dust cap 201, cone 202, voice coil former 208, magnet 209, etc.), including the spring 207, may share this central axis and be arranged coaxially.

While a single coil spring 207 is preferred in some applications, the inventive loudspeaker may include a plurality of springs 207, coaxially or non-coaxially arranged. Also, while spring 207 (and the spring element 207' introduced below) are described herein as coil springs, one of ordinary skill in the art would understand that other types of springs may also be used (e.g., helical or spiral shaped springs, cylindrical springs, or conical springs, etc.). Further, the spring element may comprise any element having sufficient elasticity and resilience to provide the restorative force described herein with respect to the moving elements of the loudspeaker system (e.g., components 201, 202, 203, 208, 206) during sound reproduction. This spring element may made from one or more metals, flexible elastomers, flexible rubber, treated fabric, etc., or any various combinations of these.

Figure 3:
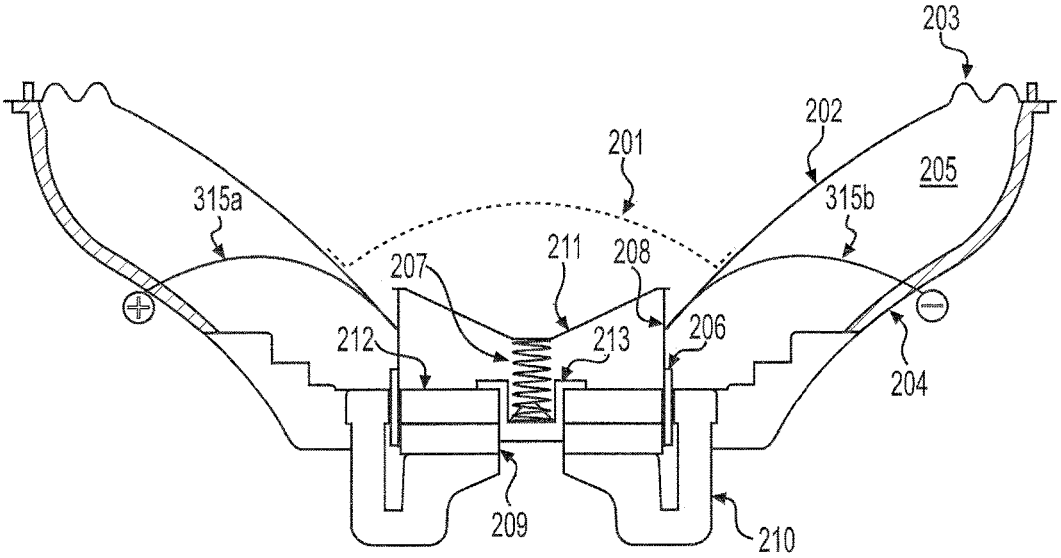
FIG. 3 is another cross-sectional view of the described loudspeaker.

The loudspeaker arrangement disclosed herein may further include lead wires 315*a* and 315*b* as shown in FIG. 3. These wires 315*a*, 315*b* extend out of the system and may be fixed to a terminal disposed in the basket 204. A portion of the wires 315*a*, 315*b*, which lies between the voice coil 208 and the terminal may be referred to as called a tinsel wire or lead wire. An exemplary polarity of the wire is indicated in FIG. 3 by "+" and "−" symbols.

The tinsel wire 315*a*, 315*b* may be looped or positioned in order to avoid hitting the cone 202 or other elements of the speaker arrangement. If this looping is not adequately performed, the drives or movements of the loudspeaker may overly stress threads of the wires 315*a*, 315*b* which can eventually lead to malfunction.

Figure 4:
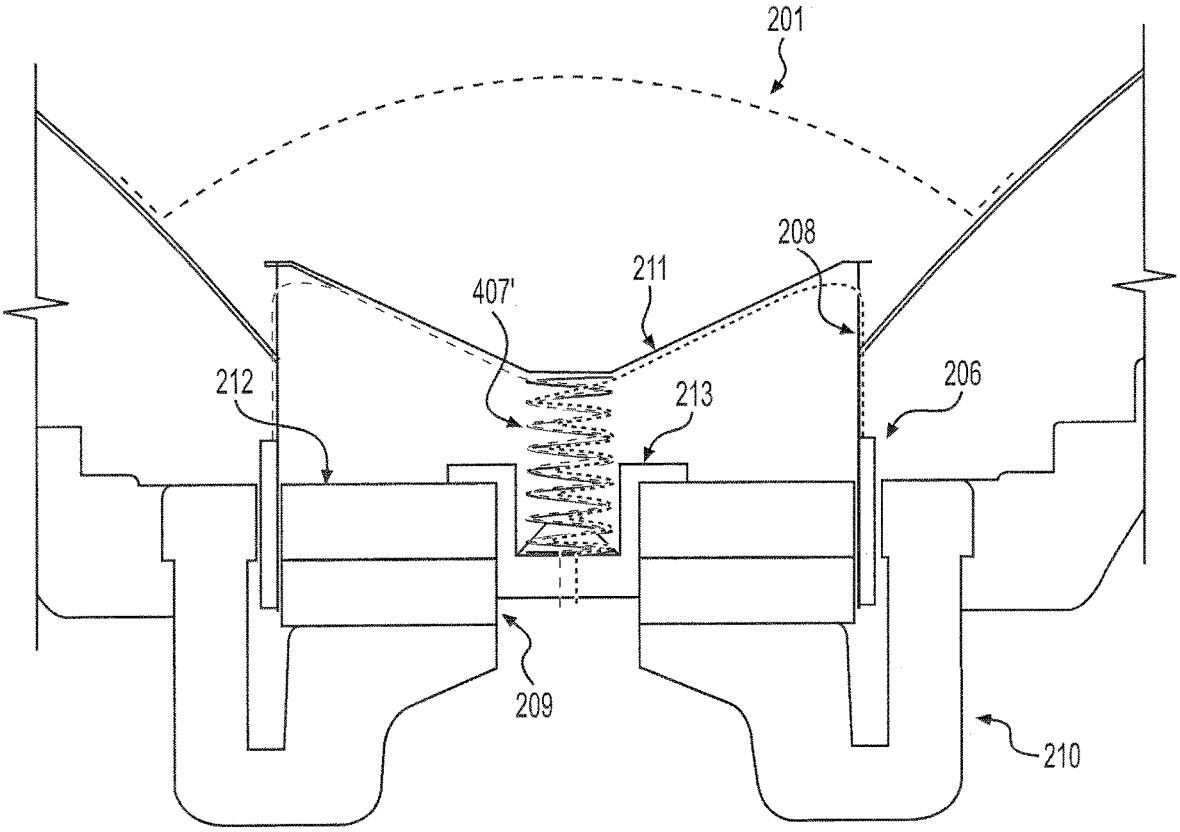
FIG. 4 is a partially enlarged view of FIG. 3 showing electrical conductivity of material forming a spring.

In other aspects of the disclosed embodiments as shown in FIG. 4, the loudspeaker arrangement may take advantage of the electrical conductivity of the material forming the exemplary metallic spring 207 to effectively use the spring 207 as a lead wire. In order to do so, the spring 207 may be formed by two coils electrically isolated from each other. FIG. 4 depicts this embodiment. Therein, a dual spring 407' acts as a tinsel wire linking the voice coil 206 to the terminal outside the system through the fixture 213. In this manner, the lead wires 315*a* and 315*b* of FIG. 3 may be eliminated. In such a configuration, the potential of these wires 315*a*, 315*b* interfering with other elements of the loudspeaker is eliminated. The loudspeaker embodiment of FIG. 4 is compact, simplified, and efficient.

As described herein, a loudspeaker structure is provided which omits the traditional spider suspension element and in its place provides a unique coil spring element disposed internally within the voice coil former and arrange coaxially therewith and with the other elements of the loudspeaker. This suspension arrangement occupies minimal space within the loudspeaker, is positioned so as not to interfere with other elements of the loudspeaker, and is provided with a more consistent and predictable stiffness.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed:

1. A suspension arrangement for an audio loudspeaker, comprising:

a spring element disposed within a voice coil former for providing a restoring force to moving elements of the audio loudspeaker during sound reproduction;

wherein the spring element includes a top portion connected to the voice coil former and an opposite bottom portion connected to a motor of the loudspeaker;

wherein the spring element is disposed coaxially with the voice coil former and with the motor; and wherein the suspension arrangement further comprises a connector disposed proximate to the top portion of the spring element, wherein the connector is connected with voice coil former, and wherein the top portion of the spring element is connected to the connector so as to connect the spring element to the voice coil former.

2. The suspension arrangement of claim 1, further comprising:

a surround connected at an outer edge to a housing of the loudspeaker and connected at an inner edge to a diaphragm;

wherein the surround and the diaphragm are disposed coaxially with the spring element.

3. The suspension arrangement of claim 2, wherein an edge of the diaphragm opposite from the surround is connected to the voice coil former.

4. The suspension arrangement of claim 1, further comprising a spring fixture disposed proximate to the bottom portion of the spring element, wherein the spring fixture is connected with the motor, and wherein the bottom portion of the spring element is connected to the spring fixture so as to connect the spring element to the motor.

5. The suspension arrangement of claim 4, wherein the connector extends from the top portion of the spring element to the voice coil former and includes a seat on an underside which is affixed to the top portion of the spring element.

6. The suspension arrangement of claim 4, wherein the spring fixture is disposed at an interior of the motor such that the bottom portion of the spring element is correspondingly located within the interior of the motor, wherein the spring fixture includes a seat on an upper side which is affixed to the bottom portion of the spring element.

7. The suspension arrangement of claim 6, wherein the spring fixture generally comprises a u-shaped cross-sectional profile having an upper rim that engages a top surface of the motor and a lower body which is recessed into the interior of the motor, the seat being disposed on the lower body.

8. The suspension arrangement of claim 1, wherein the spring element comprises a single coil spring having a longitudinal axis, wherein the single coil spring is disposed within the loudspeaker such that the longitudinal axis is co-linear with a longitudinal axis of the voice coil former and with a longitudinal axis of the motor, the longitudinal axes being parallel to a direction of movement of the voice coil former during sound reproduction.

9. The suspension arrangement of claim 1, wherein the spring element comprises an electrically conductive element having two isolated conductive paths, wherein a first conductive path has a first polarity and a second conductive path has a second polarity, wherein the first polarity is opposite to the second polarity, and wherein the first and second conductive paths extend to a terminal disposed within in the loudspeaker.

10. The suspension arrangement of claim 9, wherein the spring element comprises a dual coil spring including a first coil comprising the first conductive path and a second coil comprising the second conductive path, wherein the first and second coils are electrically isolated form one another, and wherein the first and second coils extend adjacent to one another through the dual coil spring in a tangent relationship.

11. The suspension arrangement of claim 10, wherein the dual coil spring is electrically connected to the voice coil former by an upper connector which extends from the top portion of the spring element to the voice coil former.

12. The suspension arrangement of claim 11, further comprising a fixture disposed at an interior of the motor and affixed to the lower portion of the spring element.

13. The suspension arrangement of claim 12, wherein the dual coil spring is electrically connected to the terminal through the fixture.

14. The suspension arrangement of claim 1, wherein the spring element comprises a single coil spring having a longitudinal spring axis, wherein the voice coil former has a longitudinal former axis, wherein the motor has a longitudinal motor axis, wherein the spring axis, the former axis, and the motor axis are collinear and extend in a direction parallel to a direction of movement of the voice coil former during sound reproduction.

15. A loudspeaker, comprising the suspension arrangement of claim 1.

16. A suspension arrangement for an audio loudspeaker, the loudspeaker not including a spider suspension element, the suspension arrangement comprising:

a single coil spring disposed centrally within a voice coil former; and a surround connected at one end to a basket of the loudspeaker and at an opposite end to a diaphragm;

wherein the coil spring includes a top portion connected to the voice coil former and an opposite bottom portion connected to a motor of the loudspeaker;

wherein the single coil spring includes a longitudinal spring axis, the surround includes a longitudinal surround axis, the voice coil former is configured to move in a direction of travel and includes a longitudinal former axis, and the motor includes a longitudinal motor axis;

wherein the spring axis is collinear with the surround axis, the former axis, and the motor axis;

wherein the spring axis is parallel to the direction of travel; and wherein the coil spring comprises an electrically conductive element having two isolated conductive paths, wherein a first conductive path has a first polarity and a second conductive path has a second polarity, wherein the first polarity is opposite to the second polarity, and wherein the first and second conductive paths extend to a terminal disposed within in the loudspeaker.

17. A loudspeaker, comprising the suspension arrangement of claim 16.

* * * * *